US010883309B1

(12) United States Patent
Vogeler et al.

(10) Patent No.: US 10,883,309 B1
(45) Date of Patent: Jan. 5, 2021

(54) GATE CLOSURE

(71) Applicants: Craig A. Vogeler, North Loup, NE (US); Paul W. Snodgrass, Scotia, NE (US)

(72) Inventors: Craig A. Vogeler, North Loup, NE (US); Paul W. Snodgrass, Scotia, NE (US)

(73) Assignee: Craig A. Vogeler, North Loup, NE (US)

( * ) Notice: Subject to any disclaimer, the term of this patent is extended or adjusted under 35 U.S.C. 154(b) by 403 days.

(21) Appl. No.: 15/996,900

(22) Filed: Jun. 4, 2018

(51) Int. Cl.
*E06B 11/02* (2006.01)

(52) U.S. Cl.
CPC ..... *E06B 11/021* (2013.01)

(58) Field of Classification Search
CPC ..... E06B 11/021
See application file for complete search history.

(56) References Cited

U.S. PATENT DOCUMENTS 598,494 A * 2/1898 Bennett ..... E04H 17/08 256/40
2,575,947 A 11/1951 Etnyre
2,973,595 A 3/1961 Lamphier
3,237,922 A * 3/1966 Koinzan ..... E06B 11/021 256/40
3,799,595 A 3/1974 Wahlert
4,198,086 A 4/1980 Machacek
5,098,140 A 3/1992 Kentner
5,876,075 A 3/1999 Barthelmess, Jr.

FOREIGN PATENT DOCUMENTS

CA 2419466 A1 * 8/2004 ..... E06B 11/021

* cited by examiner

*Primary Examiner* — Kristina R Fulton
*Assistant Examiner* — Yahya Sidky
(74) *Attorney, Agent, or Firm* — Dennis L. Thomte; Thomte Patent Law Office LLC

(57) ABSTRACT

A gate closure device including a U-shaped support member which is slipped over the upper end of a fence post with the base portion thereof being pivotally and slidably secured to the fence post. An elongated shaft is rotatably secured to the outer ends of the legs of the first support member. A first rod is secured to one end of the first shaft and a second rod is fixed to the other end of the first shaft. First and second crank handles and locking devices are secured to the outer ends of the first and second rods respectively. A flexible loop has its ends fixed to the first shaft which is slipped over the free end of the fence gate. The crank handles are rotated to draw the free end of the fence gate towards the fence post.

5 Claims, 7 Drawing Sheets

GATE CLOSURE

BACKGROUND OF THE INVENTION

Field of the Invention

This invention relates to a gate closure. More particularly, the invention relates to a gate closure device for attaching the free end of a barbed wire gate to a fence post to close the gate.

Description of the Related Art

Barbed wire fences are used to contain livestock or the like within a pasture or feed area or are used to prevent livestock or the like from entering an area. The fence usually has a plurality of spaced-apart fence posts embedded in the ground. A gate is provided in the fence to permit the passage of livestock or vehicles therethrough. The conventional gates usually include a plurality of horizontally extending strands of wire strands having one end thereof attached to a first fence post. The other ends of the gate usually have a vertically disposed gate post secured thereto. To close the gate, the lower end of the gate post is usually inserted into a loop on the lower end of an adjacent fence post with the upper end of the gate post being inserted into a loop at the upper end of the fence post. It is very difficult to insert the upper end of the gate post into the upper loop. Further, it is difficult to tighten the gate wires in the closed position.

It is believed that prior art gate closure devices may have been provided but it is believed that those gate closure devices were difficult to use.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A gate closure device for use with horizontally spaced-apart first and second fence posts which define a gate area and a gate including a plurality of horizontally extending wire strands which have first and second ends with the first ends of the wire strands being secured to the first fence post and a vertically disposed gate post secured to the second ends of the wire strands.

The gate closure device includes a generally horizontally disposed and generally U-shaped first support member which includes an elongated base portion with first and second ends, an elongated first leg portion, having inner and outer ends, extending from the first end of the base portion, and an elongated second leg portion, having inner and outer ends, extending from the second end of the base portion.

An elongated first collar, having inner and outer ends, is secured to the outer end of the first leg portion and is generally transversely disposed with respect to the first leg portion. An elongated second collar, having inner and outer ends, is secured to the outer end of the second leg portion and is disposed generally transversely disposed with respect to the second leg portion. An elongated first shaft, having first and second ends, is rotatably mounted in the first and second collars whereby the first end of the first shaft is positioned outwardly of the outer end of the first collar and whereby the second end of the first shaft is positioned outwardly of the outer end of the second collar.

An elongated first rod or crank arm, having inner and outer ends, has its inner end secured to the first end of the first shaft and extends generally transversely with respect thereto. An elongated second rod or crank arm, having inner and outer ends, has its inner end secured to the second end of the first shaft and extends generally transversely with respect thereto. A third collar is secured to the outer end of the first rod with the third collar being generally disposed transversely with respect to the first rod. A fourth collar is secured to the outer end of the second rod with the fourth collar being generally disposed transversely with respect to the second rod. An elongated first crank handle, having an enlarged inner end and an enlarged outer end, is rotatably and slidably mounted in the third collar. An elongated second crank handle, having an enlarged inner end and an enlarged outer end, is rotatably and slidably mounted in the fourth collar.

The gate closure device also includes an elongated and flexible loop member, having first and second ends, with the first and second ends of the loop member being secured to the first shaft at the center length of the first shaft. A fifth collar is rotatably and slidably mounted on the base portion of the first support member and a mounting plate is secured to the fifth collar for movement therewith. The mounting plate has at least two spaced-apart openings formed therein.

In use, the generally U-shaped frame is slipped over the second fence post so as to be in a generally horizontally disposed position. The mounting plate is then nailed or screwed to the second fence post. The crank handles are then slidably moved to their outer positions. The loop is then extended over the upper end of the gate post. Either of the crank handles are then rotated so as to rotate the first shaft which causes the loop to draw the vertically disposed gate post towards the second fence post. Rotation of the crank handles causes the first shaft to cause the loop to be wound upon the shaft. When the gate post has been tightly drawn to be adjacent to the second fence post, the crank handles are then slidably moved inwardly so as to be positioned outwardly of the gate post. The positioning of the crank handles in their inner positions prevents the first shaft from being rotated thereby maintaining the gate post and the gate in a tightly secured position to the second fence post.

When it is desired to open the gate, the crank handles are slidably moved outwardly with respect to the first and second rods respectively to permit the first shaft to rotate thereby permitting the loop to unwind from the shaft until the loop can be removed from the gate post.

It is a principal object of the invention to provide an improved gate closure device which is convenient to use.

A further object of the invention is to provide a gate closure device which includes structure to positively maintain the associated gate in its closed position.

A further object of the invention is to provide a gate closure device which may be manually operated from either side of the gate.

Yet another object of the invention is to provide a gate closure device which has a crank member at each side of the gate closure device.

Still another object of the invention is to provide a gate closure device which has a crank at each side of the device and wherein the cranks also serve as a locking means.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
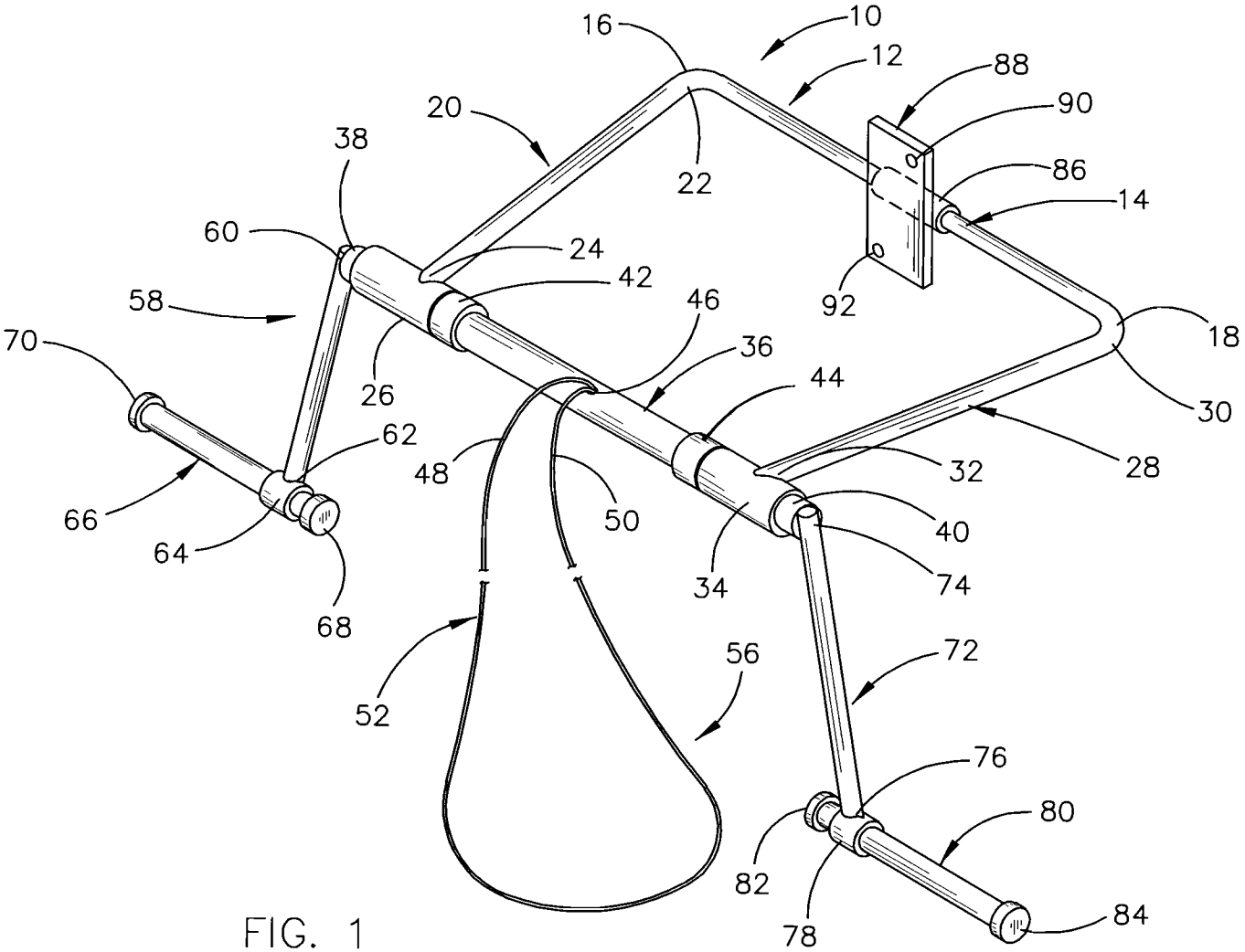
FIG. 1 is a perspective view of the gate closure of this invention.
Figure 2:
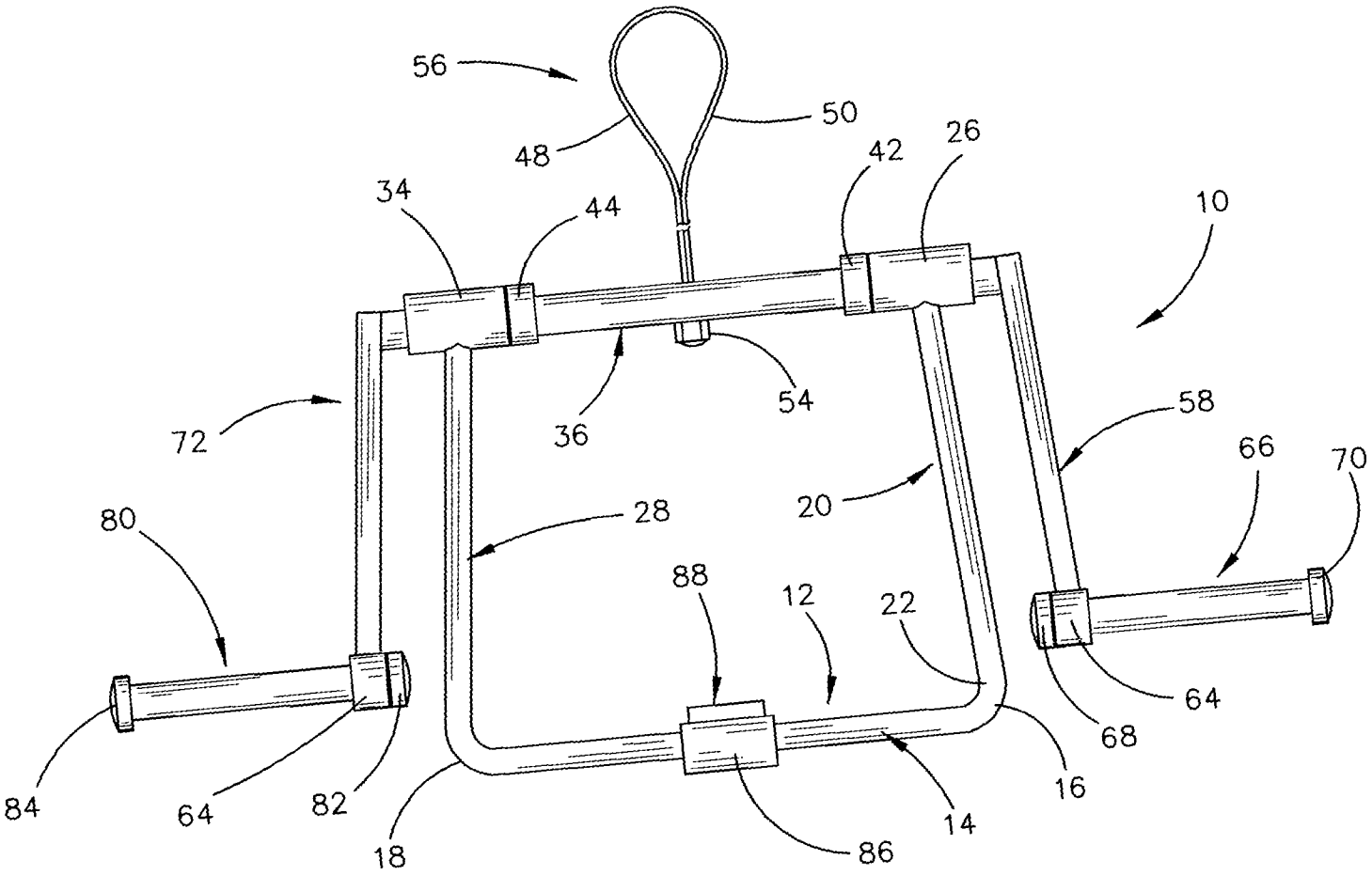
FIG. 2 is a top view of the gate closure of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The gate closure of this invention is referred to by the reference numeral 10. Gate closure 10 includes a generally U-shaped frame 12 which includes an elongated rod member 14 having a first end 16 and a second end 18. Rod member 14 has a cylindrical cross-section. Frame 12 also includes a first elongated rod member 20, having ends 22 and 24, which extends generally horizontally from the end 16 of rod member 14 and which preferably extends laterally and horizontally inwardly from end 16 of rod member 14. A horizontally disposed sleeve or collar 26 is secured to end 24 of shaft 20 and extends generally transversely horizontally with respect to shaft 20.

Frame 12 also includes a second elongated rod member 28, having ends 30 and 32, which extends generally horizontally from end 18 of rod member 14 and which preferably extends laterally and horizontally inwardly from end 18 of rod member 14. A horizontally disposed sleeve or collar 34 is secured to end 32 of rod member 28 and extends generally transversely horizontally with respect to rod member 28.

An elongated shaft 36, having ends 38 and 40, is rotatably mounted in collars 26 and 34 and extends therebetween. The ends 38 and 40 of shaft 36, protrude outwardly from the outer ends of collars 26 and 34 respectively. A collar 42 embraces shaft 36 inwardly of the inner end of collar 26 and is welded to shaft 36. A collar 44 embraces shaft 36 inwardly of the inner end of collar 34 and is welded to shaft 36. Shaft 36 has a bore 46 extending therethrough at the center thereof. The ends 48 and 50 of a flexible metal cable 52 extends through bore 46 and are maintained therein by a connector 54 secured to the free ends of cable 52. The cable 52 forms a flexible loop 56.

The numeral 58 refers to an elongated rod or crank arm having ends 60 and 62. The end 60 of rod 58 is welded to the end 38 of shaft 36. As seen, rod 58 does not extend at a 90 degree angle with respect to shaft 36 but is slightly angled from 90 degrees. A collar 64 is welded to end 62 of rod 58. As elongated rod or crank handle 66 is slidably and rotatably mounted in collar 64 and has enlarged ends 68 and 70.

The numeral 72 refers to an elongated rod or crank arm having ends 74 and 76. The end 74 of rod 72 is welded to the end 40 of shaft 36. As seen, rod 72 does not extend at a 90 degree angle with respect to shaft 36 but is slightly angled from 90 degrees. A collar 78 is welded to end 76 of rod 72. An elongated rod or crank handle 80 is slidably and rotatably mounted in collar 78 and has enlarged ends 82 and 84.

A collar 86 is slidably and rotatably mounted on rod member 14. Mounting plate 88 is welded to collar 86 and has holes 90 and 92 formed therein.

The gate closure 10 is configured to be mounted on a fence post 94 embedded in the ground 96 at one end of a gate opening 98. Fence post 94 has a conventional U-shaped strap 100 secured thereto above the ground 96. Strap 100 is configured to receive the lower end of a gate post 102 having a plurality of barbed wire strands 104 secured thereto. The outer ends of the wire strands 104 are secured to a fence post at the other end of the gate opening 98 in conventional fashion.

Figure 3:
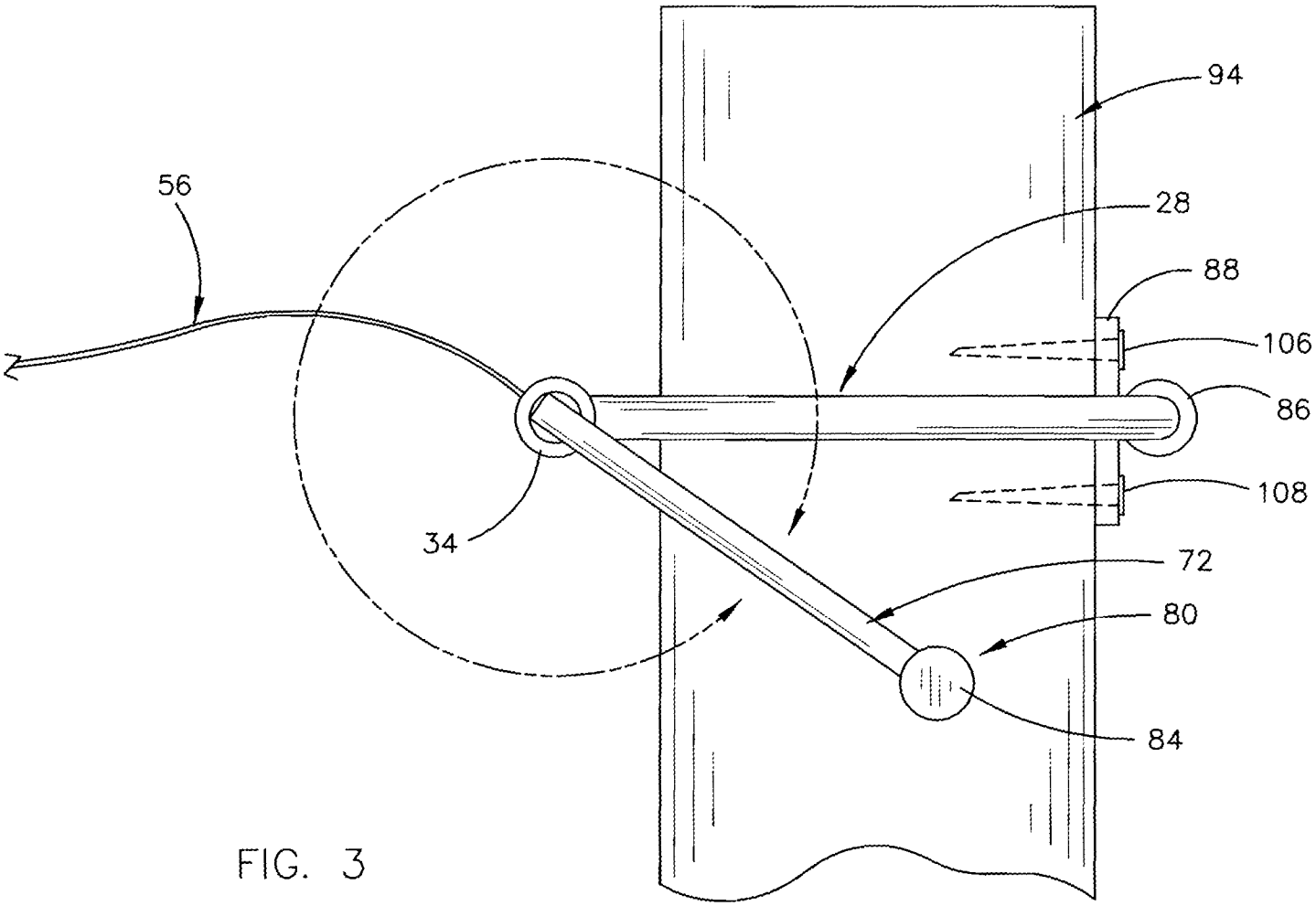
FIG. 3 is an upper elevational view of the closure device of this invention secured to a fence post.
Figure 4:
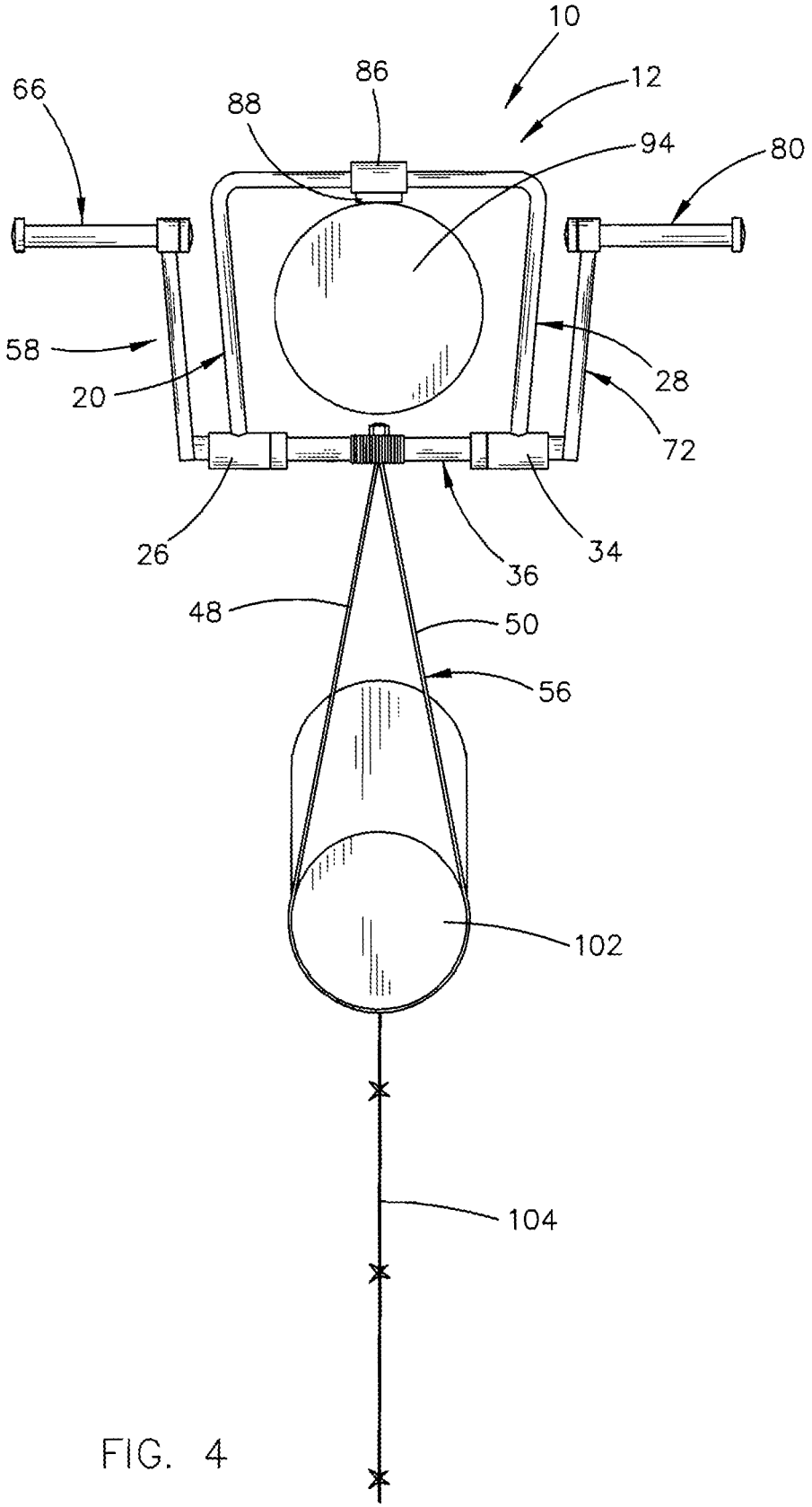
FIG. 4 is an upper elevational view of the closure device being connected to a gate post.
Figure 5:
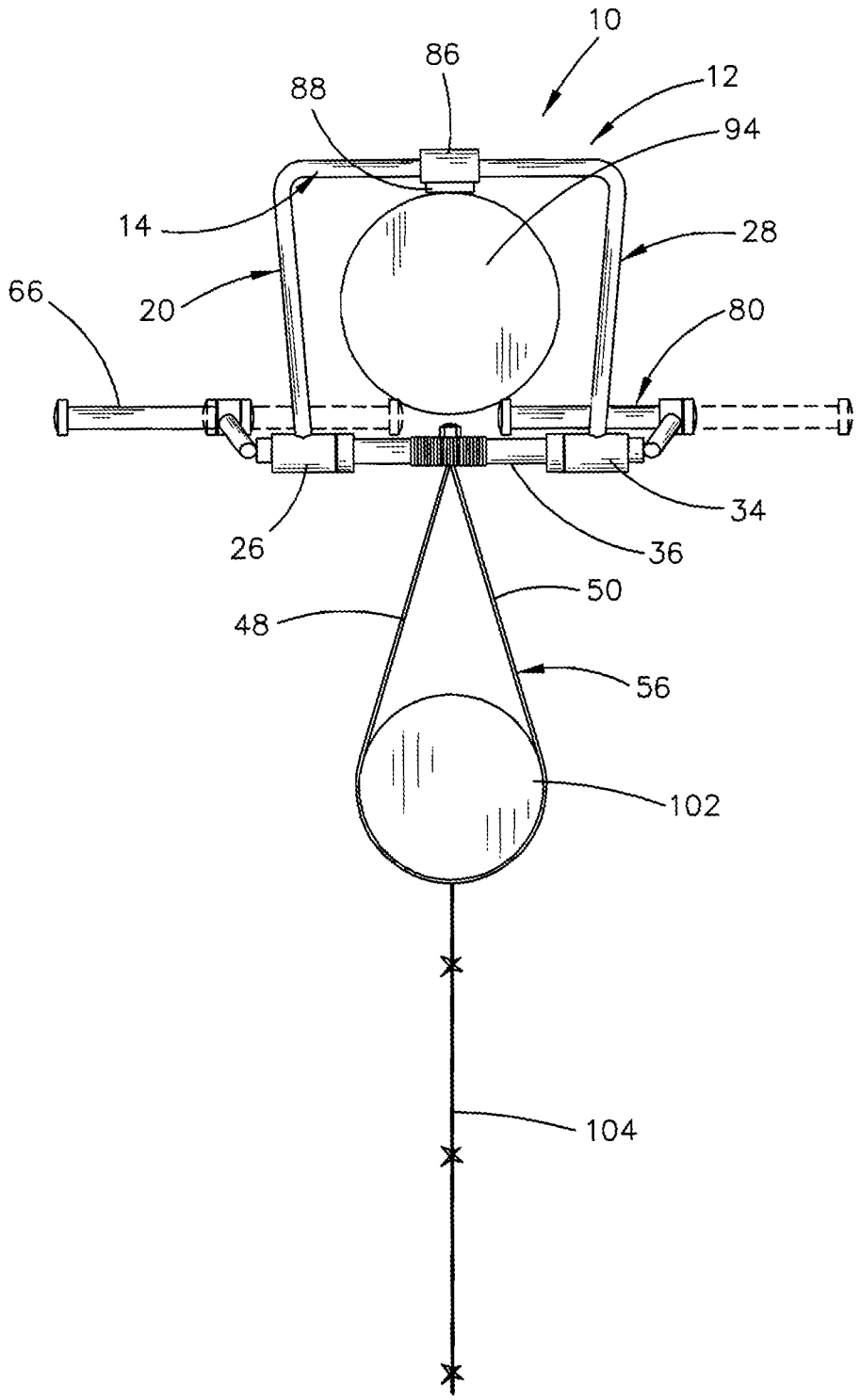
FIG. 5 is a view similar to FIG. 4 but which illustrates the gate post having been drawn into its closed position of the gate closure of this invention.
Figure 6:
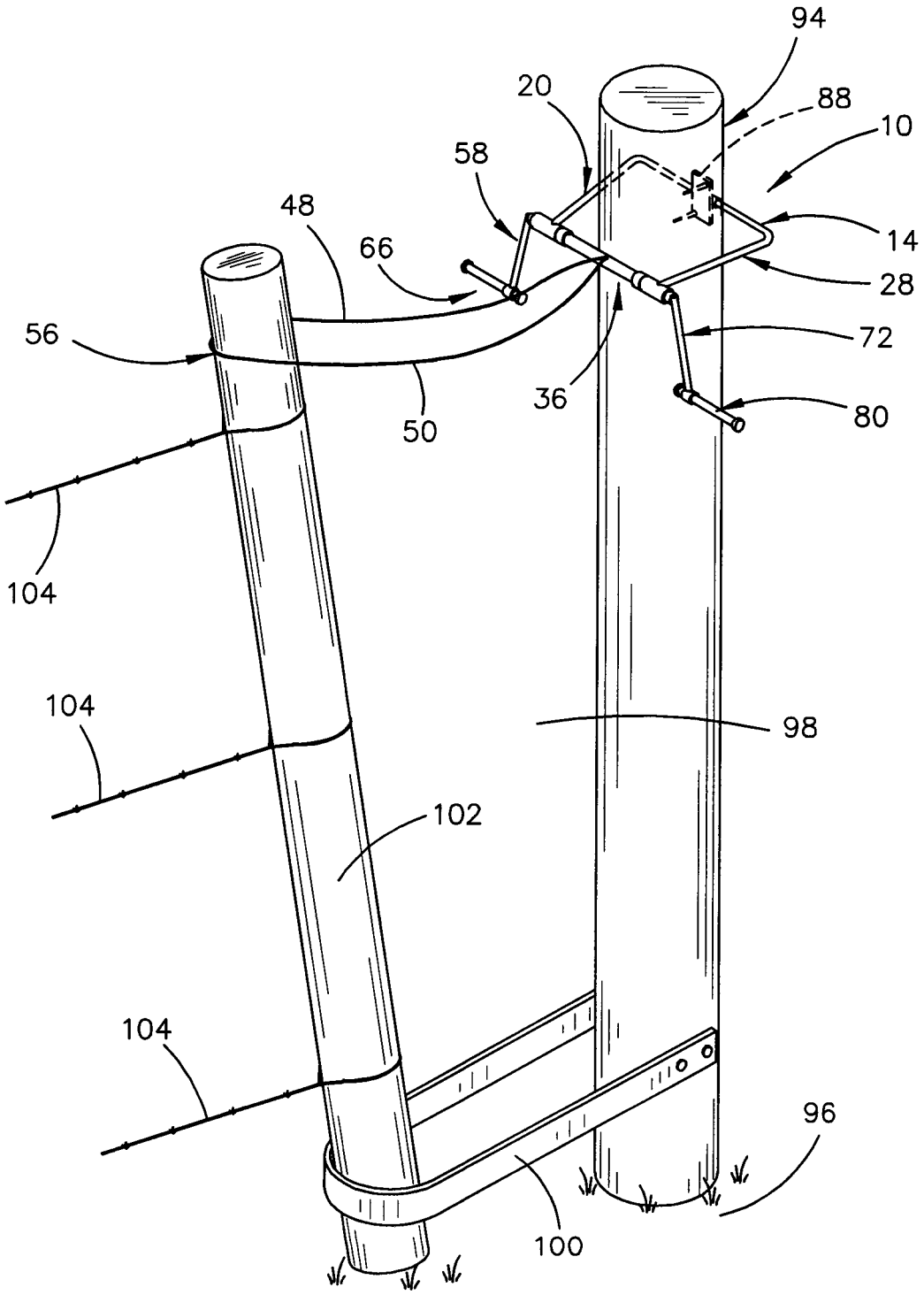
FIG. 6 is a partial perspective view which illustrates the loop of the gate closure device being secured to a gate post.
Figure 7:
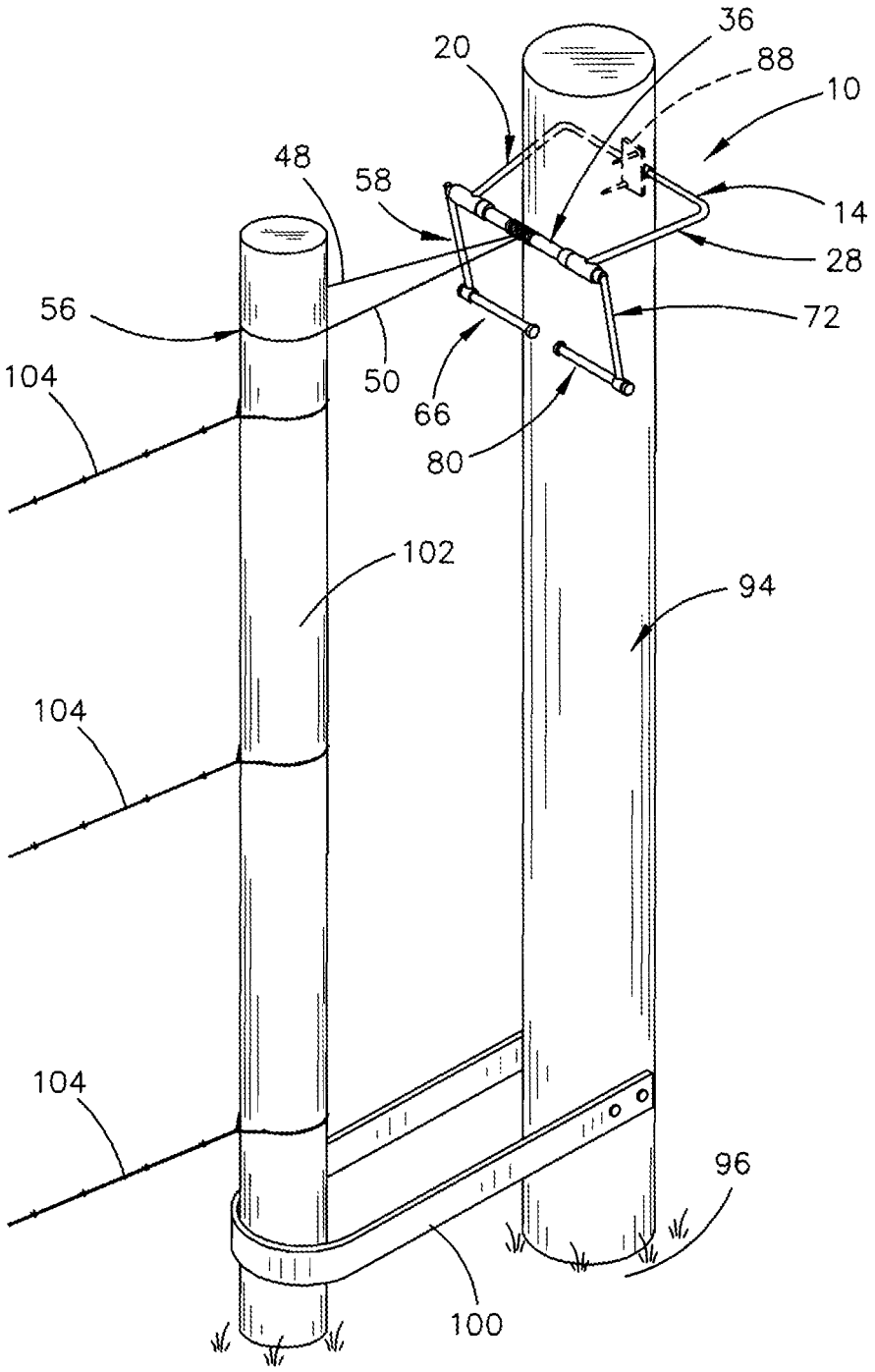
FIG. 7 is a view similar to FIG. 6 except that the gate post has been drawn towards the fence post.

The gate closure 10 is slipped over the upper end of fence post 94 as seen in FIGS. 3 and 4. Mounting plate 88 is then secured to fence post 94 by nails 106 and 108 as seen in FIG. 3. The lower end of gate post 102 is then inserted into the strap 100 as seen in FIG. 6. The loop 56 is then slipped over the upper end of gate post 102 as seen in FIG. 6. The rods or crank handles 66 and 80 will be moved to their extended positions of FIG. 6 if not already in the extended positions. The shaft 36 is then rotated in a clockwise direction as seen in FIG. 7 by either of the crank handles 66 and 80. The rotation of the shaft 36 in a clockwise direction of FIGS. 6 and 7 causes the cable 52 to be wound upon the shaft 36 thereby drawing the loop 56 at the upper end of the gate post 102 to be drawn toward the fence post 94.

When the gate post 102 has been drawn into position with respect to fence post 94, one or both of the rods 66 and 80 are slidably moved to their retracted positions of FIG. 7 so as to be positioned against fence post 94 as seen in FIG. 7 to prevent the cable 52 from unwinding from shaft 36. Thus, the crank handles 66 and 80 also serve as locking arms.

When it is desired to open the gate, the crank handles 66 and 80 are moved to their retracted positions so that the rods 58 and 72 may be rotated in a counter clockwise direction to loosen the loop 56 so that the loop 56 may be removed from the gate post 102.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A gate closure device for use with horizontally spaced-apart first and second fence posts which define a gate area and a gate including a plurality of horizontally extending wire strands which have first and second ends with the first ends of the wire strands secured to the first fence post and a vertically disposed gate post secured to the second ends of the wire strands, comprising:

a generally horizontally disposed and generally U-shaped first support member;

said first support member including an elongated base portion with first and second ends, an elongated first leg portion, having inner and outer ends, extending from said first end of said base portion and an elongated second leg portion, having inner and outer ends, extending from said second end of said base portion;

an elongated first collar, having inner and outer ends, secured to said outer end of said first leg portion;

said first collar being generally transversely disposed with respect to said first leg portion;

an elongated second collar, having inner and outer ends, secured to said outer end of said second leg portion;

said second collar being generally transversely disposed with respect to said second leg portion;

an elongated first shaft having first and second ends;

said first shaft being rotatably mounted in said first and second collars whereby said first end of said first shaft is positioned outwardly of said outer end of said first collar and whereby said second end of said first shaft is positioned outwardly of said outer end of said second collar;

an elongated first rod having inner and outer ends;

said inner end of said first rod being secured to said first end of said first shaft;

an elongated second rod having inner and outer ends;

said inner end of said second rod being secured to said second end of said first shaft;

a third collar secured to said outer end of said first rod;

said third collar being generally disposed transversely with respect to said first rod;

a fourth collar secured to said outer end of said second rod;

said fourth collar being generally disposed transversely with respect to said second rod;

an elongated first crank handle having an enlarged inner end and an enlarged outer end;

said first crank handle being rotatably and slidably mounted in said third collar;

an elongated second crank handle having an enlarged inner end and an enlarged outer end;

said second crank handle being rotatably and slidably mounted in said fourth collar;

an elongated and flexible loop member having first and second ends;

said first and second ends of said loop member being secured to said first shaft at the center length of said first shaft;

a fifth collar rotatably and slidably mounted on said base portion of said first support member;

a mounting plate secured to said fifth collar for movement therewith; and said mounting plate having at least two spaced-apart openings formed therein for receiving nails or the like extending therethrough to secure said mounting plate to said fence post.

2. The gate closure device of claim 1 wherein a sixth collar embraces said first shaft and is fixed thereto inwardly of said inner end of said first collar and wherein a seventh collar embraces said first shaft and is fixed thereto inwardly of said inner end of said second collar.

3. The gate closure of claim 1 wherein said loop member is comprised of a metal material.

4. The gate closure of claim 1 wherein said crank handles also serve as locking members to prevent rotation of said first shaft.

5. A gate closure device for use with horizontally spaced-apart first and second fence posts which define a gate area and a gate including a plurality of horizontally extending wire strands which have first and second ends with the first ends of the wire strands secured to the first fence post and a vertically disposed gate post secured to the second ends of the wire strands, comprising:

a generally horizontally disposed and generally U-shaped first support member;

said first support member including an elongated base portion with first and second ends, an elongated first leg portion, having inner and outer ends, extending from said first end of said base portion and an elongated second leg portion, having inner and outer ends, extending from said second end of said base portion;

an elongated first collar, having inner and outer ends, secured to said outer end of said first leg portion;

said first collar being generally transversely disposed with respect to said first leg portion;

an elongated second collar, having inner and outer ends, secured to said outer end of said second leg portion;

said second collar being generally transversely disposed with respect to said second leg portion;

an elongated first shaft having first and second ends;

said first shaft being rotatably mounted in said first and second collars whereby said first end of said first shaft is positioned outwardly of said outer end of said first collar and whereby said second end of said first shaft is positioned outwardly of said outer end of said second collar;

an elongated first rod having inner and outer ends;

said inner end of said first rod being secured to said first end of said first shaft;

an elongated second rod having inner and outer ends;

said inner end of said second rod being secured to said second end of said first shaft;

a third collar secured to said outer end of said first rod;

said third collar being generally disposed transversely with respect to said first rod;

a fourth collar secured to said outer end of said second rod;

said fourth collar being generally disposed transversely with respect to said second rod;

an elongated first crank handle having an enlarged inner end and an enlarged outer end;

said first crank handle being rotatably and slidably mounted in said third collar;

an elongated second crank handle having an enlarged inner end and an enlarged outer end;

said second crank handle being rotatably and slidably mounted in said fourth collar;

an elongated and flexible loop member having first and second ends;

said first and second ends of said loop member being secured to said first shaft at the center length of said first shaft;

a fifth collar rotatably and slidably mounted on said base portion of said first support member;

a mounting plate secured to said fifth collar for movement therewith; and said mounting plate configured to be secured to the fence post.

* * * * *